United States Patent [19]

Fischer

[11] 4,375,779

[45] Mar. 8, 1983

[54] COMPOSITE SEWING THREAD OF CERAMIC FIBERS

[75] Inventor: Edward M. Fischer, White Bear Lake, Minn.

[73] Assignee: Minnesota Mining and Manufacturing Company, St. Paul, Minn.

[21] Appl. No.: 257,401

[22] Filed: Apr. 24, 1981

[51] Int. Cl.[3] ..... D04C 1/02; D04C 1/12; D02G 3/16; D02G 3/46

[52] U.S. Cl. ..... 87/6; 57/210; 57/903; 428/366; 501/1

[58] Field of Search ..... 428/364, 366, 404; 106/39.5, 55, 73.4; 57/6, 7, 12, 207, 210, 224–226, 229, 232–235, 903; 87/1, 5–9

[56] References Cited

U.S. PATENT DOCUMENTS

| | | | |
|---|---|---|---|
| 2,649,833 | 9/1953 | Crandall | 87/1 |
| 2,712,263 | 7/1955 | Crandall | 87/1 |
| 2,735,258 | 2/1956 | Crandall | 57/234 |
| 2,861,417 | 11/1958 | Crandall | 57/7 |
| 3,410,078 | 11/1968 | Freedman et al. | 57/903 X |
| 3,565,127 | 2/1971 | Nicely et al. | 87/6 X |
| 3,709,706 | 1/1973 | Sowman | 106/57 |
| 3,722,202 | 3/1973 | Indarte | 57/210 |
| 3,735,579 | 5/1973 | Catlos | 57/235 X |
| 3,745,756 | 7/1973 | Crandall | 57/234 |
| 3,751,897 | 9/1973 | Bailey | 57/224 |
| 3,791,658 | 2/1974 | Zumeta et al. | 277/230 |
| 3,793,041 | 2/1974 | Sowman | 106/57 |
| 3,795,524 | 3/1974 | Sowman | 106/65 |
| 3,807,162 | 4/1974 | Taujita et al. | 57/226 X |
| 3,909,278 | 9/1975 | Johnson | 106/65 |
| 3,952,496 | 4/1976 | Nagel et al. | 57/207 |
| 4,047,965 | 9/1977 | Karst et al. | 106/65 |
| 4,070,818 | 1/1978 | Hamel | 57/210 X |
| 4,125,496 | 11/1978 | Sowman | 106/57 |
| 4,145,473 | 3/1979 | Samuelson et al. | 428/373 |
| 4,166,147 | 8/1979 | Lange et al. | 428/328 |
| 4,176,705 | 12/1979 | Russell et al. | 152/359 |

*Primary Examiner*—John Petrakes

*Attorney, Agent, or Firm*—Cruzan Alexander; Donald M. Sell; Lorraine R. Sherman

[57] ABSTRACT

A composite fiber sewing thread comprising a central core having one or more strands of an inorganic or organic fiber or blends thereof, and an outer jacket enclosing the core and having the form of a tubular body of braided strands of continuous ceramic fibers is disclosed. The thread is useful in very high temperature applications.

20 Claims, 3 Drawing Figures

COMPOSITE SEWING THREAD OF CERAMIC FIBERS

TECHNICAL FIELD

This invention relates to a composite sewing thread of ceramic fibers, the thread being suitable for very high temperature applications. In another aspect, it relates to a process for making the ceramic fiber sewing thread. In a further aspect, it relates to ceramic fabric articles sewn with the thread.

BACKGROUND ART

A number of ceramic fibers and fabrics woven therefrom are a development of recent years. These fibers have provided commerce with a new family of fabrics or textiles which have a high tensile strength and modulus and the ability to maintain these properties at elevated temperatures. An inherent property of ceramic fibers, however, is their somewhat brittle nature, that is, the inability of the fiber to withstand bending stresses. When sewing thread made of such ceramic fibers is subjected to short radius stress, such as encountered in the sewing needle of machines or in the tying of knots, twisted ceramic fiber sewing thread is prone to breakage. Due to this problem, tedious and labor intensive hand-sewing has been employed to fabricate articles made from ceramic fiber fabrics or cloths that need to be sewn or tied with ceramic fiber sewing thread. As an alternative to hand- sewing, newly developed high temperature (i.e., greater than 1000° C.) insulating fabrics are being machine-sewn with thread made of conventional twisted fiber construction and having a lower temperature use level than the fabric, even though such thread deteriorates at high use temperatures. Thus, there is need for a machine sewing thread which maintains its high tensile strength and modulus for prolonged periods at temperatures up to 1150° C. and for at least short periods at temperatures up to 1430° C., and which thread is resistant to abrasion, shrinkage, and moisture absorption, and is chemically inert.

Prior art threads lack the high temperature resistance desired in many applications. Many have organic fiber components which burn out at temperatures above 300° C., resulting in disintegration of the fiber component and failure of the product for its intended use. One type of commercial fused silica sewing thread having a twisted construction begins to deteriorate at 500° C. When this thread is sewn into fabrics made, for example, of alumina-boria-silica fibers (Nextel® 312), which are high temperature resistant up to about 1430° C., the heat causes failure of the thread and the subsequent deterioration of the stitching. Alumina-boria-silica fibers as disclosed in U.S. Pat. No. 3,795,524 comprise aluminum borosilicate, the alumina-boria mol ratio being 9:2 to 3:15.

When damaged by abrasion or cutting, twisted thread constructions suffer from the disadvantage of unraveling. The result is a peel-back of all or part of the fibers behind the sewing needle or machine bobbin thread guide resulting in a broken or weak stitch. High modulus fibers are particularly susceptible to this problem.

U.S. Pat. No. 3,791,658 teaches a packing material for sealing movable elements of pumps, valves, and the like comprising a core of "Teflon" polytetrafluoroethylene or fiberglass asbestos impregnated with Teflon polytetrafluoroethylene and an outer tubular jacket of wrapped or braided graphite filaments. U.S. Pat. Nos. 2,649,833 and 2,712,263 teach composite strings for racquets utilizing a center core of twisted synthetic plastic filaments that is integrated with a braided jacket of plastic filaments and one or more coatings of thermoplastic material.

Composite threads, twines, and cords having core and sheath constructions are known in the art. Composite threads generally have superior specific properties over single component threads. The sheath constructions are twisted, twistless, tangled, or plastic coated strands and the core constructions are spun staple, twisted, false twisted, twistless, plastic integrated, multi-core or spaced-apart core strands. See, for example, U.S. Pat. Nos. 2,735,258, 2,861,417, 3,722,202, 3,735,579, 3,745,756, 3,807,162, 3,751,897, 3,952,496, 4,070,818, 4,145,473, and 4,176,705.

DISCLOSURE OF INVENTION

Briefly, the present invention provides a composite fiber sewing thread comprising a central core having one or more strands of inorganic or organic fibers or blends thereof, and an outer jacket enclosing the core and having the form of a tubular body of braided strands of continuous ceramic fibers.

The sewing thread of the present invention is flexible and not susceptible to fracture and unraveling under the stress inflicted by machine sewing and which would result in weak or broken stitches. The thread of the present invention eliminates the need for laborious hand sewing. In addition, the integrity of the stitches sewn with the thread of the present invention is maintained at very high temperatures, i.e., up to 1430° C. when alumina-boria-silica fibers are used. Also, the thread of the present invention is virtually resistant to shirnkage and to moisture, and is chemically inert. The somewhat brittle ceramic fibers are provided in a braided tubular form surrounding the core strand (organic and/or inorganic fibers) which core acts as a cushion for sharp bend stresses during the sewing process and gives the sewing thread more fracture resistance. The core, when made of organic fibers, is heat fugitive i.e., the fibers are volatilized or burned away in a high temperature exposure. The remaining inorganic structure maintains the integrity of the stitches in the sewn article.

"Flexible" as used herein means having sufficient pliability to withstand sharp radius bends without fracturing, as exemplified by having the ability to be tied into a closed overhand knot without failure of the thread.

"Yarn" means any twisted or untwisted fiber strand.

"Composite" means made up of distinct parts.

"Blends" means combinations of two or more different fibers; the fibers may be organic or inorganic.

"Modulus" means modulus of elasticity.

"Fiber" means a thread-like or monofilament structure having a length at least 100 times its diameter.

"Roving" means an assembly of one or more strands without twist.

"Pick" refers to the number of braid cross-overs per 2.54 cm.

"Heat fugitive" means volatilizes, burns, or decomposes upon heating.

"Strand" means a plurality of fibers.

"Continuous fiber" means a fiber (or monofilament) which has a length which is infinite for practical purposes as compared to its diameter.

BRIEF DESCRIPTION OF DRAWINGS

In the accompanying drawing:

Referring to FIGS. 1 and 2, one embodiment 10 of the sewing thread of the invention is shown with core strands 12 and 14, which strands may be of the same fibers or different, and preferably one strand 12 is a yarn made up of continuous organic fibers 13, such as twisted or untwisted rayon, polyester, polyamide, elastomeric, cotton, but most preferably it is a 300 to 600 denier twisted continuous or staple aramid fiber (Kevlar®), and one strand 14 is of inorganic refractory fibers 15, such as continuous fused silica fibers (e.g., Astroquartz®), thoria-silica metal (III) oxide fibers (see U.S. Pat. No. 3,909,278), zirconia-silica fibers (see U.S. Pat. Nos. 3,793,041 and 3,709,706), alumina-silica fiber (see U.S. Pat. No. 4,047,965) graphite fiber, alumina-chromia metal (IV) oxide fiber (see U.S. Pat. No. 4,125,406), titania fibers (see U.S. Pat. No. 4,166,147) refractory metal wire (such as nickel-chrome alloys). Preferably, strand 14 is continuous alumina-boria-silica ceramic fibers, having an alumina:boria mol ratio of 9:2 to 3:1.5, and containing up to 65 weight percent silica, preferably 20 to 50 weight percent silica, as described in U.S. Pat. No. 3,795,524. Nextel 312, a roving of a commercially available fiber described in 3 M Bulletins, e.g., N-MHFOL(79.5)MP, N-MPBFC-2(109.5)11, N-MPBVF-1(89.5)11, N-MTDS(79.5)MP, N-MPBBS-(89.5)11, and N-MOUT(89.4)MP). The organic strand 12 cushions the yarn against sharp bend stresses; the power sewing machine process may require any portion of thread to pass through the eye of a sewing machine needle quickly up to 80 times without fracturing. The organic strand 12 is heat fugitive in a high temperature exposure. The core strands 12 and 14 may have 25 to 1000 continuous fibers each and are 50 to 1800 denier. Preferably, the inorganic strand contains 130 to 390 continuous fibers, and is 400 to 900 denier.

Figure 1:
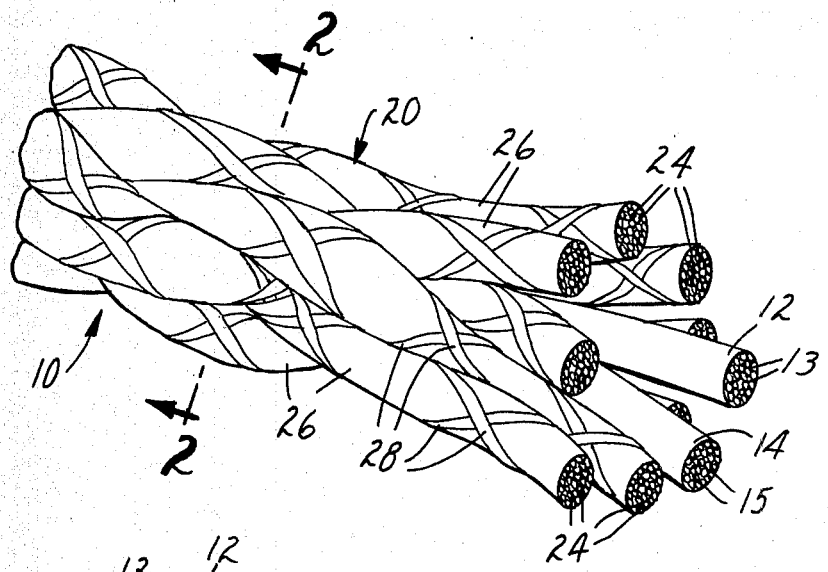
FIG. 1 is an enlarged isometric schematic view of a representative portion of one embodiment of the sewing thread of this invention.
Figure 2:
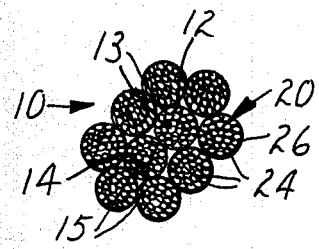
FIG. 2 is a cross-sectional view of FIG. 1 taken along the plane 2—2.

The outer jacket 20 surrounding core strands 12 and 14 has a braided tubular form of eight strands 26, although it may have more or less than eight strands, e.g., four to sixteen strands, so long as the thread has a diameter small enough so that it fits through the eye of the needle, and a linear density of five to thirty picks and preferably ten to twenty picks, and most preferably 10.5 picks per 2.54 cm. Each single jacket strand 26 is made of continuous ceramic fibers 24 mentioned above, i.e., fused silica, zirconia-silica, thoria-silica metal (III) oxide, alumina-silica, alumina-chromia metal (IV) oxide, titania, and preferably is alumina-boria-silica ceramic fiber (Nextel 312), and has 130 to 780 fibers in each strand and is 200 to 1800 denier. Preferably each strand 26 contains 390 fibers and is 600 denier. Each strand 26 is served (wrapped) 28 with yarn (any fine denier supportive organic fibers as described above for core strand 12, that does not decompose upon heating to cause failure of the thread, is suitable); preferably each strand is double served with 50 denier rayon, in order to prevent unraveling of the strand during the manufacture of the thread, the rayon being burned off upon high temperature heating.

In making the thread each strand 26, which is a continuous fiber yarn, is sized with a lubricant, e.g., a blend of polyethylenimine and polyethyleneglycol wax (Carbowax® 600, Union Carbide, Inc.) or polytetrafluoroethylene (PTFE), to facilitate the thread production process. The size can be removed in a heat cleaning operation at temperatures of 300° C. and above.

The outer jacket of the sewing thread is braided using a conventional machine such as the New England Butt Model 2, or the standard Wardwell textile braider, using 8 or 16 carriers. After the braiding process, the thread is coated with a fiber binder and lubricant, e.g., vinyl acetate-ethylene copolymer (Airflex®) with polytetrafluoroethylene which partly saturates the braid, to facilitate the power sewing machine process by minimizing abrasion and breakage of the sewing thread and reduce the sliding friction coefficient during sewing.

As mentioned above, the organic fiber core strand 12 and the serving 28 surrounding each braided strand 26 is burned off upon the exposure of the thread to high temperature. The thread loses part of its strength after it is heated for prolonged period at temperatures up to 1150° C. and for short periods at temperatures up to 1430° C., but its residual strength and flexibility is superior to that of other threads known in the art which deteriorate at 500° C., and its tensile strength and modulus are sufficient for its intended use in maintaining the integrity of the stitches.

DETAILED DESCRIPTION

A preferred high temperature flexible sewing thread of the present invention is a ceramic fiber sewing thread comprising a central core or fiber bundle having two strands of fibers, one strand made up of continuous or staple organic fibers, such as aramid fibers, and one strand made up of continuous ceramic fibers, such as alumina-boria-silica fibers, and an outer jacket enclosing or surrounding the core, the jacket having the form of a tubular body of eight braided strands of continuous ceramic fibers, such as alumina-boria-silica fibers.

Figure 3:
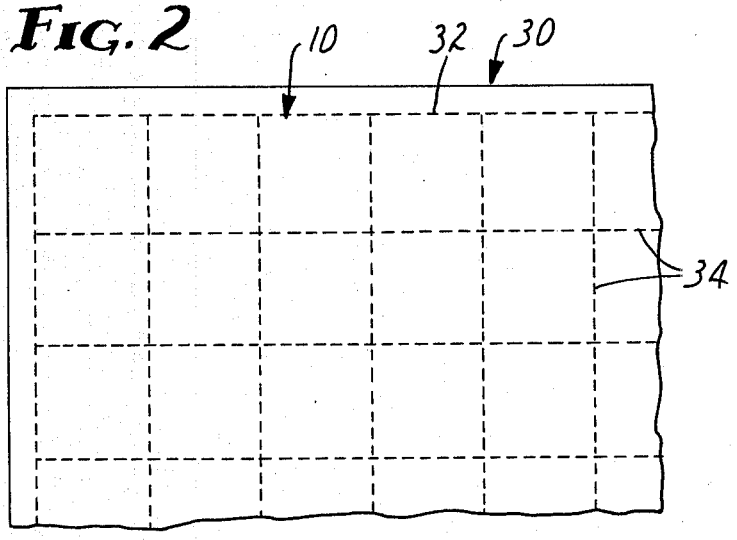
FIG. 3 is a schematic plan view of one type of article, i.e., a quilt, sewn with the sewing thread of this invention.

FIG. 3 represents a quilted bat useful for insulation. The bat is of a sandwich-like construction made up of two pieces of ceramic fabric (which can be made of Nextel fibers) with insulating staple ceramic fibers, such as Kaowool®, between them. The fabric and insulating fibers are retained in place by stitching the construction along its periphery 32 and its interior area in any desired pattern 34 using the thread of the present invention.

The sewing thread of the present invention is useful in any machine or hand sewing or support tying application where thread having superior tensile strength, abrasion resistance, and flexibility is required at prolonged temperatures up to 1150° C. and up to 1430° C. in the short term, i.e., using Nextel 312 fibers. Such thread is useful, for example, in the fabrication of furnace curtains and vacuum furnace linings, insulation for heating elements, sleevings, hose coverings and tapes, and in thermal barriers for aerospace applications. The thread is useful to sew together ceramic fiber batting or insulation for insulating furnaces or other heat processing equipment, especially combinations of ceramic fiber fabrics and ceramic fiber batting or other sewable articles. The thread is also useful in sewing braided gaskets and baghouse filters.

Objects and advantages of this invention are further illustrated by the following examples, but the particular materials and amounts thereof recited in these examples, as well as other conditions and details, should not be construed to unduly limit this invention.

EXAMPLE 1

A series of the sewing threads of this invention, i.e., samples 1–10, 12–14, and 17–19, and comparison threads, i.e., examples 11, 15, and 16, where made as described above and evaluated using standard methods, i.e., ASTM D-204-71 and ASTM D-2256. The threads were evaluated as a strand and knot, before and after heating which burned away any organic based core material that was present. The nineteen sample threads studied are described in TABLE I. All samples had 8 strands in the tubular braid, except sample 18 which had 16 strands. All samples were sized with polyethylenimine blended with polyethylene glycol, except samples 12, 15, and 16 were sized with PTFE.

TABLE I

| | Sewing Thread Construction | | | |
|---|---|---|---|---|
| Sample | Braid[a] | Serving[b] | Core[c] | Picks[d] |
| 1 | Nextel | Rayon-D | Aramid | 15.5 |
| 2 | Nextel | Rayon-D | Ceramic | 15.5 |
| 3 | Nextel | Rayon-D | Glass | 15.5 |
| 4 | Nextel | Rayon-D | Rayon | 15.5 |
| 5 | Nextel | Rayon-D | Polyamide | 15.5 |
| 6 | Nextel | Rayon-D | Cotton | 15.5 |
| 7 | Nextel | Rayon-D | Polyester | 15.5 |
| 8 | Nextel | Rayon-D | Aramid | 26 |
| 9 | Nextel | Rayon-D | Aramid | 10.5 |
| 10 | Nextel | Rayon-S | Aramid | 10.5 |
| 11 | Nextel | Rayon-S | None | 10.5 |
| 12 | Nextel-900 | None | Aramid | 10.5 |
| 13 | Nextel | Rayon-D | Elastomer | 15.5 |
| 14 | Nextel | Rayon-D | Wire | 15.5 |
| 15 | Astroquartz | None | None | 10.5 |
| 16 | Astroquartz | None | Aramid | 10.5 |
| 17 | Nextel | Rayon-D | Aramid | 15.5 |
| 18 | Nextel | Rayon-D | Aramid | 18.0 |
| 19 | Nextel | Rayon-D | Aramid/ ceramic | 10.5 |

[a]Braid
Nextel: Nextel® 312, 390 single fibers per strand, 600 denier per strand, single end
Nextel 900: Nextel® 312, 390 single fibers per strand, 900 denier, ½ plied yarn
Astroquartz: Astroquartz® plied yarn, a fused silica fiber
[b]Serving Outer wrap on fiber to hold fiber bundle together which allows it to be wound into a braider package and machine braided
Rayon D: Double spiral wrap of 50 denier rayon yarn
Rayon S: Single spiral wrap of 50 denier rayon yarn
[c]Core Samples 1–18 were single strand
Sample 19 was double strand
Ceramic - Nextel 312
Glass - E glass fiberglass
Aramid - Kevlar®, 450 denier
Wire - nickel-chrome superalloy wire (Tophet® 30)
[d]Picks Picks per 2.54 cm (the number of yarn crossings per 2.54 cm, or the linear density of the braided yarn)

In Table II, the test results are summarized. Samples 1–7, 13, and 14 were compared as to core materials. The data of TABLE II show results obtained when samples having different core strands, fiber denier, and type of sewing were evaluated. Samples 15 and 16 used Astroquartz twisted fiber and were evaluated as controls. Sample 12 showed the effect of 900 denier fiber in the braid. Samples 17 and 18 compared the machine sewing thread (0.039 cm dia.) with hand sewing thread (0.054 cm dia.) and the higher pick count. The next three samples (8–10) compare the tightness of the braid (see TABLE I). Sample 11 had no core strand. A key factor evaluated was machine sewability of the thread.

TABLE II

| | Sewing Thread Strength Test Results (Kilograms to Break)[f] | | | | |
|---|---|---|---|---|---|
| | Strength as made | | Strength after heating at 800° C. for 10 sec. | | |
| Sample+ | Strand | Knot | Strand | Knot | Variable[g] |
| 1 | 14 | 5.4 | 4.5 | 0.9 | Aramid core |
| 2 | 14.4 | 5.0 | — | 1.6 | Ceramic core |
| 3 | 28 | 9.9 | — | 2.7 | Glass core |
| 4 | 11.3 | 4.5 | 3.2 | 0.99 | Rayon core |
| 5 | 12.2 | 5.4 | 5.0 | 1.2 | Polyamide core |
| 6 | 11.3 | 3.6 | 4.5 | 1.3 | Cotton core |
| 7 | 12.6 | 5.0 | 4.5 | 1.1 | Polyester core |
| 8 | 9.0 | 3.6 | — | — | Aramid core |
| 9 | 18.0 | 3.6 | 5.6 | 0.77 | Aramid core |
| 10 | 14 | 2.7 | 4.1 | 0.77 | Aramid core |
| 11 | 14.9 | 2.7 | 5.4 | 1.3 | No core |
| 12 | 30 | 12.2 | 5.0 | 2.5 | Braid/denier |
| 13 | 10.8 | 4.1 | 3.2 | 0.77 | Elastomeric core |
| 14 | 13.5 | 4.1 | 6.8 | 3.3 | Wire core |
| 15 | 41 | 34 | 2.3 | 1.4 | Astroquartz braid/no core |
| 16 | 38.7 | 30.5 | 1.8 | 1.7 | Astroquartz braid/aramid core |
| 17 | 13.5 | 5.9 | 5.0 | 0.86 | Aramid core |
| 18 | 31.1 | 11.7 | 9.9 | 2.8 | Aramid core |
| 19 | 15.4 | 4.8 | 4.1 | 1.1 | Aramid braid/ ceramic core |

+See Table I
[f]Data as kilograms tensile, ASTM D-204-71 and ASTM D-2256. The knot strength evaluated holding strength when sewing thread was tied off
[g]Unless stated, braid was Nextel 312 strands The results in the foregoing table show that the threads having organic or wire cores provided the required tensile strength and flexibility for a good sewing thread during the sewing operation. After heating to 800° C., only the ceramic fiber residual strength was able to provide the physical properties needed. Sample 11, with no core strand was tested further; it had good high temperature (greater than 1000° C.) strength but fractured upon machine sewing. The wire core thread, upon further testing was found to be useful in short-term high temperature exposure (e.g., up to 1400° C.).

As to machine sewability, the threads of samples 1, 5, 6, 7, 14, 17, and 19 were rated good (acceptable); the threads of the remaining samples were unacceptable for machine sewing.

EXAMPLE 2

The strengths of the alumina-boria-silica braided sewing thread having a diameter of 0.1 cm, sample 19 of Example 1 (A), were compared with twisted fused silica sewing thread (B) having a diameter of 0.05 cm. The data is presented in Table III. Percent strength loss was calculated according to the following formula:

$$\frac{(\text{original strength}) - (\text{strength after-heat treated}) \times 100}{\text{original strength}}$$

TABLE III

| Strengths of Sewing Thread (Sample 19), A, and Astroquartz® Q 18 Twisted Sewing Thread, B, (Kilograms in tensile by ASTM D-204-71 and ASTM D-2256) | | |
|---|---|---|
| Procedure[h] | A | B |
| 15.24 cm strand strength 1.27 cm/min XHD[i] coated (sized) | 15.5 | 7.9 |
| 15.24 cm strand strength heated, 750° C., 10 min. | 4.21 73% strength loss | 0.91 89% strength loss |

TABLE III-continued

| Strengths of Sewing Thread (Sample 19), A, and Astroquartz ® Q 18 Twisted Sewing Thread, B, (Kilograms in tensile by ASTM D-204-71 and ASTM D-2256) | | |
|---|---|---|
| Procedure[h] | A | B |
| 15.24 cm knot strength 0.51 cm/min XHD[i] coated (sized) | 4.85 | 5.67 |
| 15.24 cm knot strength heated, 750° C., 10 min | 0.73 85% strength loss | .086 98% strength loss |
| 50 mil bend[j] 0.5 cm/min XHD[i] coated (sized) | 12.5 | 13.8 |

[h]15.24 cm gage length used for strand and knot strength
[i]Instron ® crosshead speed
[j]Breaking strength over 180° arc on a 50-mil (1270 micron) rod, 15.24 cm guage length The data of Table III show the high strength, particularly after heating, exhibited by the sewing thread of the present invention (A) compared to prior art thread (B).

EXAMPLE 3

Seam strength of cloth made with Nextel 312 fibers hand-sewn with sewing thread A and with sewing thread B were evaluated at 15.24 cm gage length, 10 stitch seam in center, using ASTM D-1682 procedure, were determined. The results are summarized in Table IV.

TABLE IV

| Seam Strength Data | A | B |
|---|---|---|
| Hand sewn | cloth failed, seam in tact, at 35.4 kg | seam failed at 26.75 kg |
| Heated 850° C., 5 min. | thread broke 11.33 kg | thread broke 2.26 kg |
| Strength loss | 68% | 91% |

The data of TABLE IV show the high strengths, particularly after heating, exhibited by cloth samples sewn with braided sewing thread of the present invention as compared with twisted fused silica fiber sewing thread (Astroquartz Q18).

EXAMPLE 4

Sewing thread A (sample 19 of Example 1) was used in a commercial sewing machine evaluation. A 24% by weight coating, composed of 80% by weight vinyl acetate-ethylene copolymer and 20% by weight PTFE, was applied to the thread. A Juki America industrial sewing machine was used which was specifically adapted for sewing inorganic fabrics with inorganic sewing threads. In all runs the sewing was performed with 1.75 stitches per cm at a speed of 3.5 stitches per second using a Federal Standard stitch type 301 lock.

For purposes of comparison, the following articles were sewn with threads A and B of Example 1. The articles and procedures are described in TABLE V.

TABLE V

| SAMPLE | |
|---|---|
| 20 | Fabric made of Nextel 312 fibers (710 g/m$^2$), was doubled and sewn with a double row seam to make a 15.2 × 28 cm (6" × 11") sample. |
| 21 | A 15.2 × 15.2 cm (6" × 6") quilted sample was made from .75 cm Fiberfrax ® (Carborundum Co.) silica/alumina ceramic fiber batting sandwiched between two layers of fabric (710 g/m$^2$) made of Nextel 312 fibers. The quilting was made with 40 inches (102 cm) of stitching to give a fine quality insulative batting. |
| 22 | The construction of sample 21 was repeated on a larger size batting, 30.5 × 35.5 cm (12" × 14") using 290 lineal inches (737 cm) of stitching to make the quilted batting. |
| 23 | A batting construction 28 × 30.5 cm (11" × 12") was made using Fiberfrax batting sandwiched between Astroquartz silica fabric and fiberglass (E-glass fabric). Quilting was performed with 65 inches (165 cm) of thread A using a type 301 lock stitch. |
| 24 & 25 | To evaluate the holding strength after exposure to elevated temperatures, two Nextel 312 fabrics were sewn together using sewing thread A with a single row 301 lock stitch seam 8 inches long (20.3 cm). The sewn fabric was placed in a 900° C. (1652° F.) oven for five minutes, after which time it was removed. A similar construction, except that the sewing thread was sewing thread B, was made and similarly heat treated. |

Evaluation of samples 20–23, sewn on an industrial sewing machine, showed that the threads of the present invention performed very well. They did not damage the yarns or punch through as normally encountered with inorganic sewing threads. Thread A of sample 24, after being heat treated as described above, had good integrity and strength. Thread B of Sample 25 lost essentially all strength in the same test.

Various modifications and alterations of this invention will become apparent to those skilled in the art without departing from the scope and spirit of this invention, and it should be understood that this invention is not to be unduly limited to the illustrative embodiments set forth herein.

I claim:

1. A composite sewing thread comprising:

a central core having one or more strands of inorganic or organic fibers or blends thereof, and an outer jacket enclosing said core and having the form of a tubular body of braided strands of continuous ceramic fibers, said braided strands being served with fibers selected from inorganic and organic fibers.

2. The sewing thread according to claim 1 wherein said central core comprises one or more strands of organic fibers.

3. The sewing thread according to claim 2 wherein said organic fibers are selected from the group consisting of rayon, polyester, polyamide, elastomeric, cotton, and aramid fibers.

4. The sewing thread according to claim 2 wherein said organic fibers are aramid fibers.

5. The sewing thread according to claim 2 wherein said organic fibers are heat fugitive.

6. The sewing thread according to claim 1 wherein said central core comprises one or more strands of inorganic fibers.

7. The sewing thread according to claim 6 wherein said inorganic fibers selected from the group consisting of fused silica, alumina-silica, zirconia-silica, alumina-chromia metal (IV) oxide, titania, thoria-silica metal (III) oxide graphite, refractory metal wire, and alumina-boria- silica fibers.

8. The sewing thread according to claim 6 wherein said inorganic fibers are alumina-boria-silica ceramic fibers.

9. The sewing thread according to claim 1 wherein said ceramic fibers are alumina-boria-silica fibers.

10. The sewing thread according to claim 9 or 8 wherein said inorganic fibers are alumina-boria-silica fibers having an alumina:boria mol ratio of 9:2 to 3:1.5, and containing up to 65 weight percent silica.

11. The sewing thread according to claim 1 wherein said strands of said central core each have a number of fibers in the range of 25 to 1000 and a fiber denier in the range of 50 to 1800.

12. The sewing thread according to claim 1 wherein said jacket has 4 to 16 strands.

13. The sewing thread according to claim 1 wherein said jacket has a linear density of 5 to 30 picks.

14. The sewing thread according to claim 1 wherein said ceramic fibers are selected from fused silica, alumina-silica, thoria-silica metal (III) oxide, zirconia-silica, alumina-chromia metal (IV) oxide, titania, and alumina-boria-silica fibers.

15. The sewing thread according to claim 1 wherein said strands in said jacket each have a number of fibers in the range of 130 to 780 and a denier in the range of 200 to 1800 denier.

16. The sewing thread according to claim 1 the strength of which is maintained up to 1150° C.

17. A composite sewing thread comprising:

a central core having one strand of continuous or staple aramid fibers, said strand having a fiber denier in the range of 300 to 600, and one strand of continuous alumina-boria-silica fibers, said strand having a number of fibers in the range of 130 to 390 and a fiber denier in the range of 400 to 900, and an outer jacket enclosing said core and having the form of a tubular body of 8 braided strands of continuous alumina-boria-silica fibers, each braid strand having a number of fibers in the range of 130 to 780 and a fiber denier in the range of 200 to 1800, each braided strand being double served with 50 denier rayon yarn, and said tubular body having a number of picks in the range of 10 to 20 picks per 2.54 cm, said alumina-boria-silica fibers having an alumina:boria mol ratio of 9:2 to 3:1.5, and containing up to 65 weight percent of silica.

18. A high temperature resistant article sewn with the sewing thread according to claim 1.

19. A high temperature resistant fabric article sewn with the sewing thread according to claim 1.

20. A composite sewing thread comprising:

a central core having one or more strands of inorganic or organic fibers or blends thereof, and an outer jacket enclosing said core and having the form of a tubular body of braided strands of continuous ceramic fibers.

* * * * *